US008019515B2

(12) United States Patent
Okeson et al.

(10) Patent No.: US 8,019,515 B2
(45) Date of Patent: Sep. 13, 2011

(54) IMPLEMENT CONTROL SYSTEM FOR AN ALL TERRAIN OR UTILITY VEHICLE AND METHOD

(75) Inventors: Shane Okeson, Detroit Lakes, MN (US); Dave Osterman, Detroit Lakes, MN (US)

(73) Assignee: TEAM Industries, Inc., Audubon, MN (US)

( * ) Notice: Subject to any disclaimer, the term of this patent is extended or adjusted under 35 U.S.C. 154(b) by 634 days.

(21) Appl. No.: 12/202,786

(22) Filed: Sep. 2, 2008

(65) Prior Publication Data

US 2009/0105911 A1 Apr. 23, 2009

Related U.S. Application Data

(60) Provisional application No. 60/968,999, filed on Aug. 30, 2007.

(51) Int. Cl.
*E01H 5/04* (2006.01)

(52) U.S. Cl. ..... 701/50; 254/323; 37/231; 37/236

(58) Field of Classification Search ..... 701/49, 701/50; 254/323, 328, 330, 265–267; 37/231, 37/234–236, 407

See application file for complete search history.

(56) References Cited

U.S. PATENT DOCUMENTS

| | | | | |
|---|---|---|---|---|
| 4,807,375 | A | 2/1989 | Iraci | |
| 4,991,323 | A * | 2/1991 | Benkler | 37/235 |
| 5,901,476 | A | 5/1999 | Buonfiglio | |
| 6,334,269 | B1 * | 1/2002 | Dilks | 37/235 |
| 7,302,765 | B1 * | 12/2007 | Jorgenson et al. | 37/231 |
| 7,849,614 | B2 * | 12/2010 | Belzile et al. | 37/231 |
| 2005/0206126 | A1 * | 9/2005 | Harris | 280/479.1 |

* cited by examiner

*Primary Examiner* — Ruth Ilan
(74) *Attorney, Agent, or Firm* — IPLM Group, P.A.

(57) ABSTRACT

Controller for an all terrain or utility vehicle for automatically raising and lowering an implement to a pre-selected position using an electric winch. The winch is turned for a predetermined time during with the winch is turned, and based on the selected lowered position and the predetermined time the winch may be raised to the same height, denoting a raised position. Based on that predetermined time, a second predetermined time may be determined to run the winch in the opposite direction, with the time corresponding to the amount of time required the snow plow to the selected lowered position. The time to lower the plow may tend to be less than the time required to raise the plow due to the effect of gravity. The controller may raise or lower the plow after the transmission has been set from neutral to reverse or forward, respectively.

27 Claims, 8 Drawing Sheets

IMPLEMENT CONTROL SYSTEM FOR AN ALL TERRAIN OR UTILITY VEHICLE AND METHOD

RELATED APPLICATION

This application claims priority from U.S. Provisional Patent Application No. 60/968,999, Okeson et al, Implement Control System for an All Terrain or Utility Vehicle and Method, filed on Aug. 30, 2007.

FIELD

The present invention is related to control mechanisms for vehicle mounted implements and, more particularly, to controls systems for an implement mounted with respect to an all terrain or utility vehicle and methods for control of an implement mounted with respect to an all terrain or utility vehicle.

BACKGROUND

All terrain and/or sport utility vehicles are useful for many tasks. Such all terrain and/or sport utility vehicles typically travel on air pressured tires or tracks. Commonly such vehicles have a seat to be straddled by an operator and are steered by handlebars although other seating and control configurations, e.g., a steering wheel or hand or foot operated control levers, are possible. Three or four wheels are commonly utilized although other wheel configurations, such as six or more wheels are contemplated. Such vehicles are often very maneuverable configured for ease of starting, stopping, reversing and turning as well as ease at handling in small spaces or uneven terrain.

All terrain and/or sport utility vehicles are often outfitted with vehicle accessories, such as a blade or plow or winch, to enable the vehicle to perform additional tasks such as grading earth or plowing snow. Accessory implements often are mounted with respect to the vehicle such that the implement may be raised or lowered, or otherwise adjusted, with respect to the frame or body of the vehicle in order to effect an appropriate action. For example, a blade or plow may commonly have two operable positions, either raised or lowered. In the lowered position, the blade attached to the vehicle may be used to move or otherwise affect material in the path of the vehicle, e.g., blading a roadway or earth or plowing or moving snow or ice. In the raised position, the blade may be lifted out of its working position with material otherwise affected, e.g, so that the vehicle may maneuver into position such the implement may again be lowered to again affect material in the path of the vehicle.

Operating an all terrain or sport utility vehicle may involve the movement of a plurality of controls, either simultaneously or within a close period of time. For example, the throttle and steering, e.g., handlebars, may need to adjusted simultaneously in order to control the vehicle. The clutch and/or brake and/or transmission levers also need to be adjusted in nearly this same period of time. Of course, operators of all terrain or sport utility vehicles are generally familiar with the operation of such controls either through prior operation of all terrain or sport utility vehicles or through prior operation of other vehicles.

In some all terrain or utility vehicles, the implement, such as a blade or plow, is operated, e.g., raised and lowered, through the operation of a cable attached to a winch, typically an electric winch. Winding the winch in a direction to retrieve cable causes the implement to be raised. Winding the winch in the opposite direction causes the implement to be lowered by gravity. However, the exact positioning of the implement operated with a winch system is sometimes difficult to predict.

The addition of an implement to an all terrain or sport utility vehicle may necessarily involve at least an additional set of controls. The implement, e.g., a blade or plow, may need to be raised or lowered in roughly the same time frame as other operational controls also need to be operated. Further, the implement may need to be operated or maneuvered to a particular height or position relative to the frame or body of the vehicle in order to most advantageously facilitate its use.

SUMMARY

Being able to automatically, to a certain extent, have the implement attached to an all terrain or utility vehicle controlled in an advantageous manner would relieve the operator of at least one level of control operation. If, for example in an embodiment, the implement was raised and/or lowered to a predetermined position could allow the operator to simply indicate the direction of movement of the implement and automatic control would position the implement appropriately. As another example in another embodiment, for use in blading or snowplowing operations, the blade or plow is typically engaged, i.e., lowered, when the vehicle is moving forward, or in a first direction, while the blade or plow is typically disengaged, i.e., raised, when the vehicle is moving backward, or in a second direction.

An embodiment makes plowing with an all terrain or utility vehicle easier with the introduction of the snow plow system, which automatically raises and lowers the plow blade as the vehicle's operator shifts between forward and reverse. The easy-to-install snow plow system automatically raises the plow blade when the vehicle is put out of neutral into reverse, and it lowers the blade to the height pre-set by the operator when the vehicle is shifted out of neutral into a forward gear.

The snow plow system makes plowing jobs go faster and easier because it allows the operator to concentrate on steering and operating the throttle and brake rather than having to shift repeatedly. The snow plow system also reduces the risk of damaging winches and cables. The operator sets the plow blade at the desired plowing height, pushes the "Set" button and the snow plow system does the rest as the vehicle plows snow, dirt or other materials. The operator can also manually control the plow blade height with the snow plow system installed on the vehicle.

The new snow plow system can be installed on numerous all terrain and utility vehicle makes and models. It installs easily and can be used with all types of plow blades and winches.

An embodiment provides a control mechanism for an implement that, in an embodiment, may be mounted on an all terrain or utility vehicle. In an embodiment, the implement is a snow plow that is hooked up to a cable of an electrically powered winch. Depending on how the winch is turned, in an embodiment the height of the snow plow, whether in a raised or a lowered position, may be selected.

In an embodiment, a user may select the height of the lowered position manually using the control mechanism. In a further embodiment, the control mechanism is programmed with a predetermined time during with the winch is turned, and based on the selected lowered position and the predetermined time the winch may be raised to the same height, denoting a raised position. Based on that predetermined time, a second predetermined time may be determined to run the winch in the opposite direction, with the time corresponding to the amount of time required the snow plow to the selected lowered position. In an embodiment, it is recognized that the time to lower the plow may tend to be less than the time required to raise the plow due to the effect of gravity.

In a further embodiment, the controller may be operatively connected to the transmission system of the vehicle. In an embodiment, when the transmission is placed in reverse gear, the controller may raise the plow by turning the winch in direction needed to raise the plow for the predetermined period of time. In a further embodiment, when the transmission is placed in forward gear the controller may lower the plow by turning the winch in the direction needed to lower the plow for the second predetermined time. It is envisioned that various other selected transmission gears and sequences of selected transmission gears may cause the controller to raise or lower the plow, either in addition to the above-described embodiments, or as a substitute for the above described embodiments. In one envisioned embodiment, the controller may raise or lower the plow after the transmission has been set from neutral to reverse or forward, respectively.

In various embodiments, the plow may be substituted by various implements, such as rotating-blade snow plows, saws, shovels, gripping implements, and various other implements known in the art. In further embodiments, the plow or other implements may be mounted in various configurations on the vehicle, such as on the front of the vehicle, the rear of the vehicle, or to the left or right side. In various embodiments, the plow or implement may be oriented in various positions and directions.

In various embodiments, the plow or other implement may be maneuvered by raising and lowering or by any other useful physical positioning or adjusting arrangement, such as, but not limited to, opening and closing, rotating clockwise and counterclockwise, starting motion and stopping motion, moving in or out, and/or any combination or combinations of the above.

DRAWINGS

Figure 1:
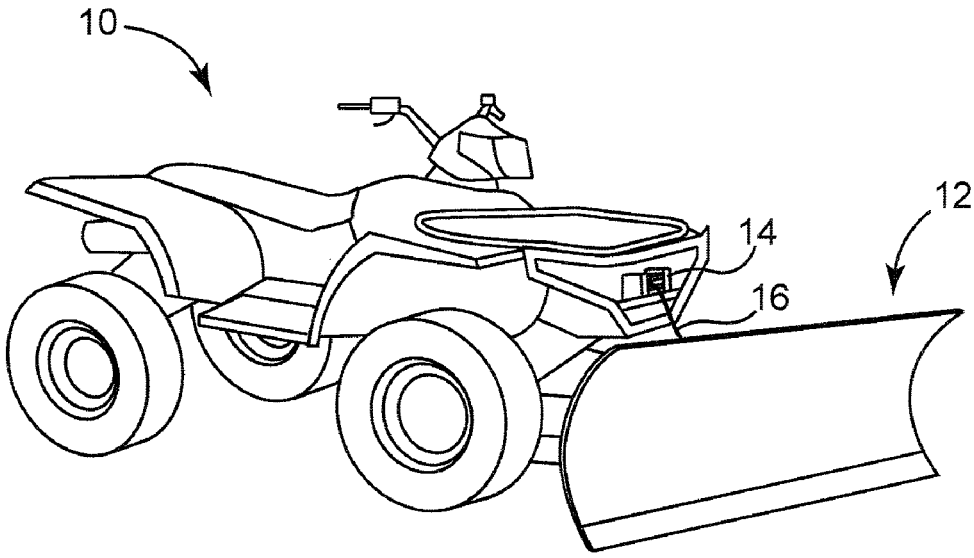
FIG. 1 illustrates an all terrain mounted with an implement.
Figure 2:
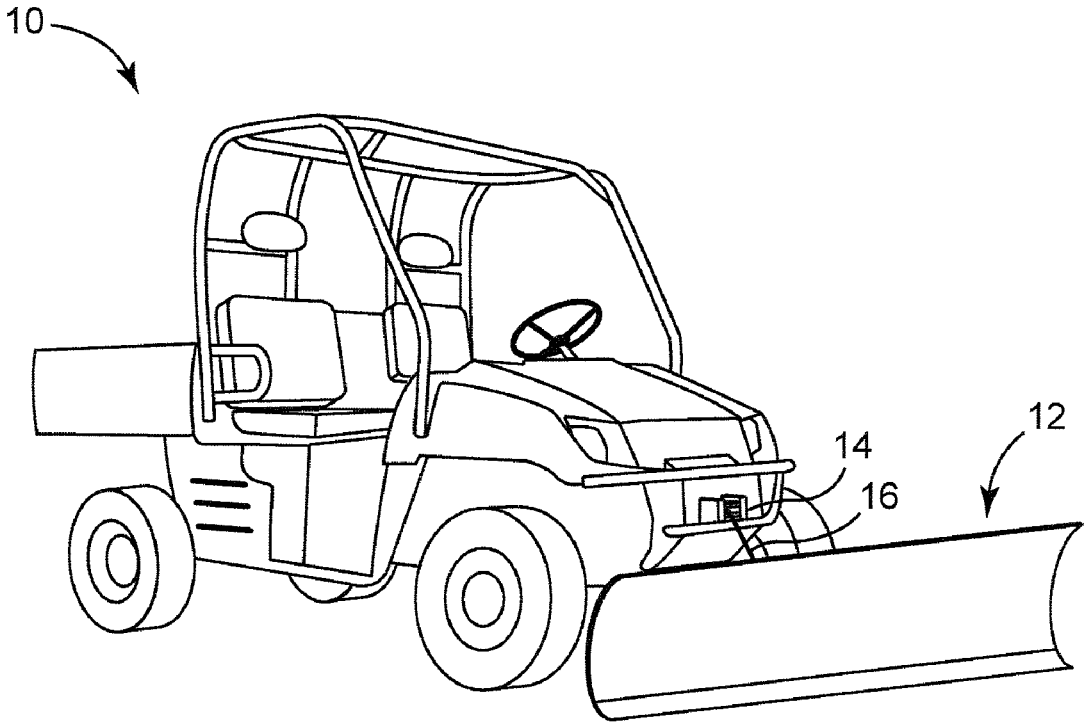
FIG. 2 illustrates a sport utility vehicle mounted with an implement.
Figure 3:
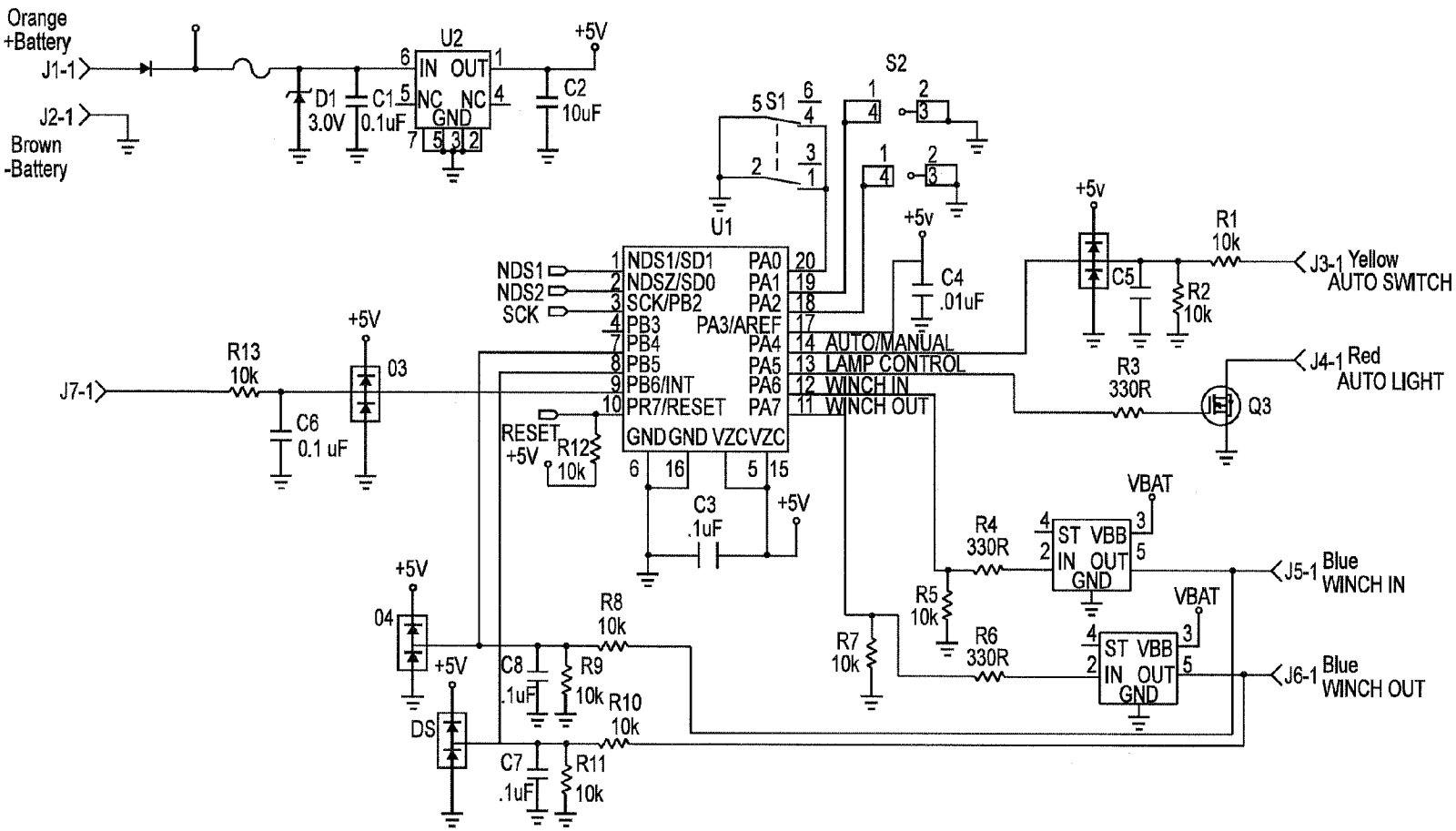
FIG. 3 is a schematic of the controller utilized in an embodiment.
Figure 4A:
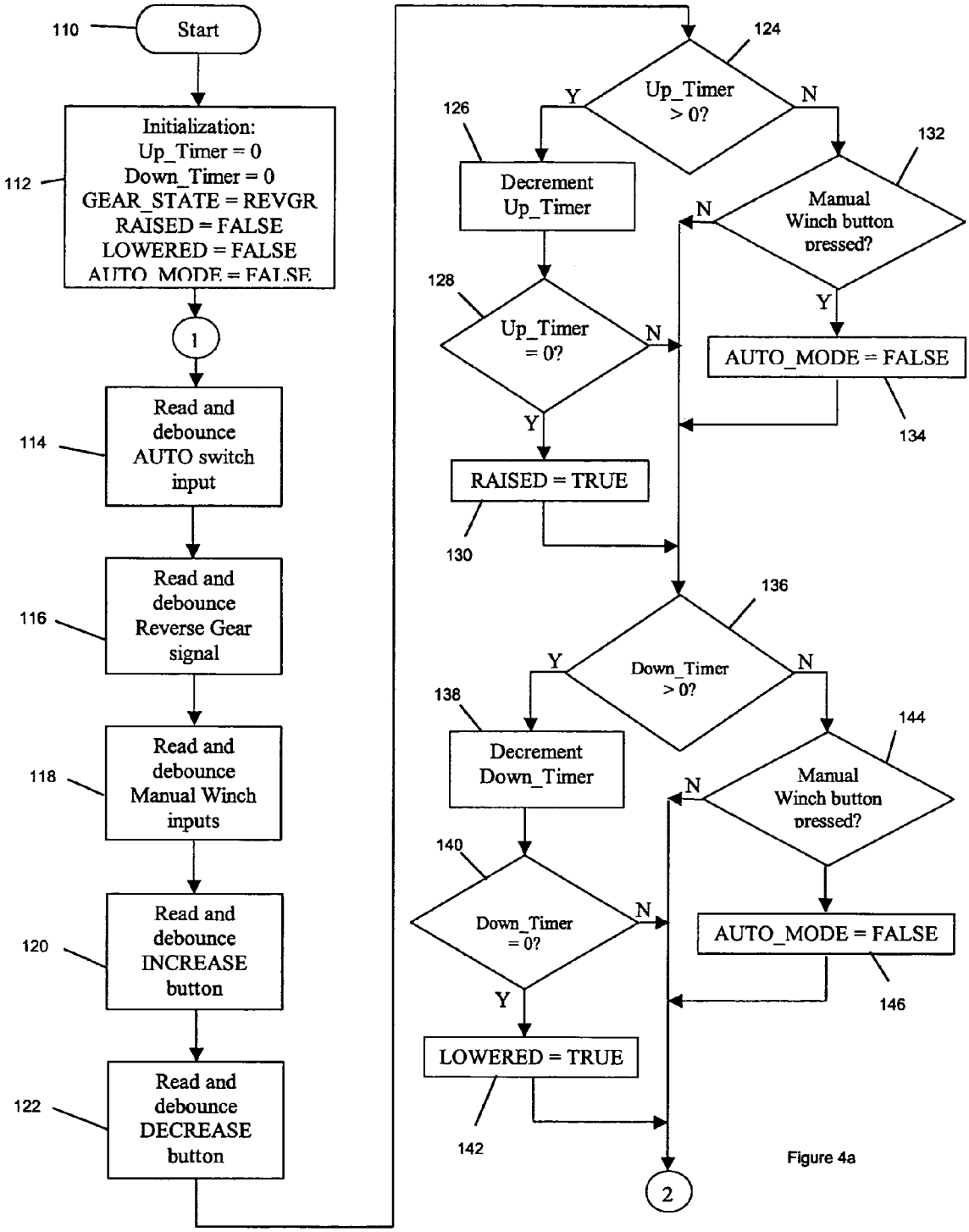
Figure 4B:
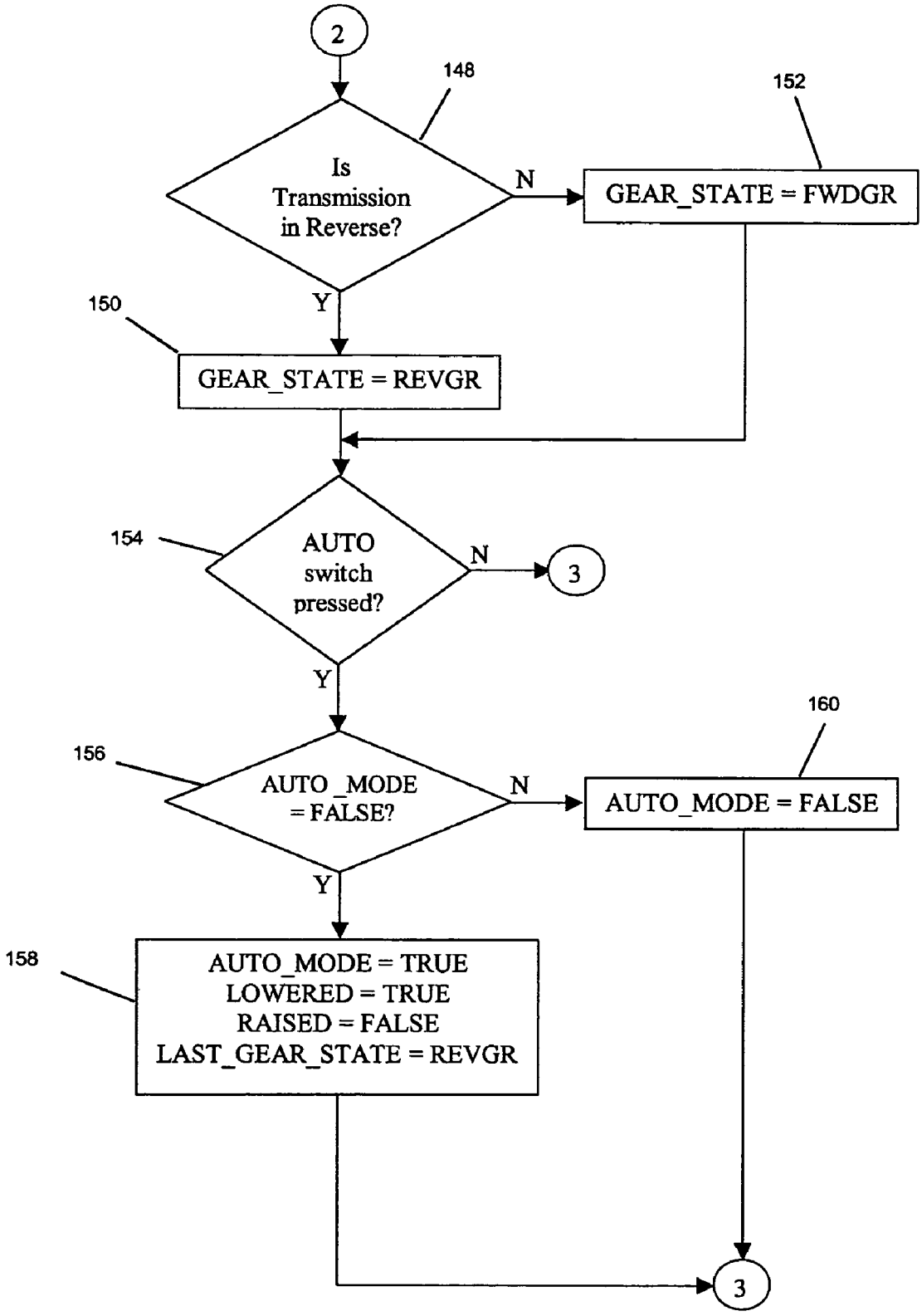
Figure 4C:
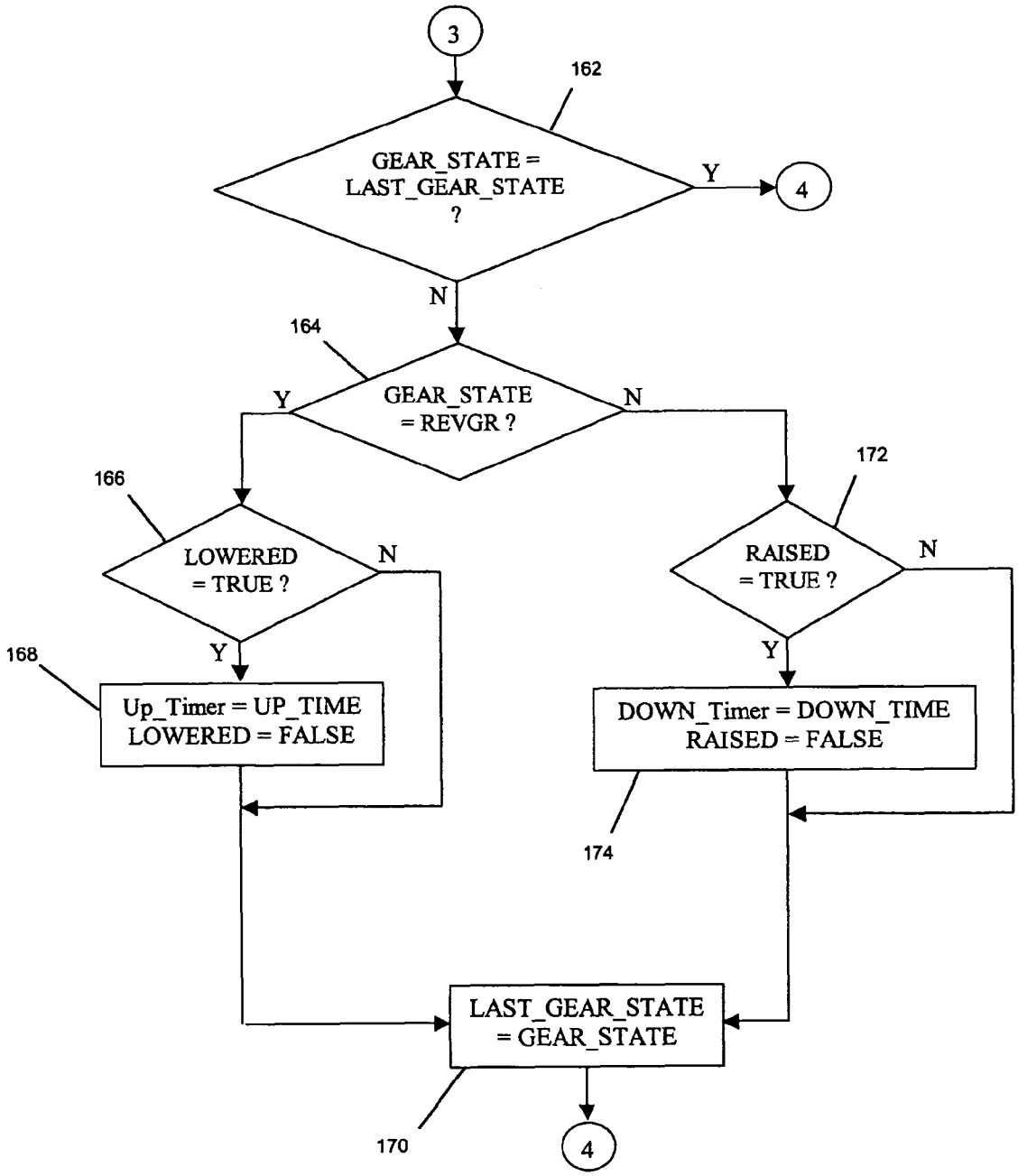
Figure 4D:
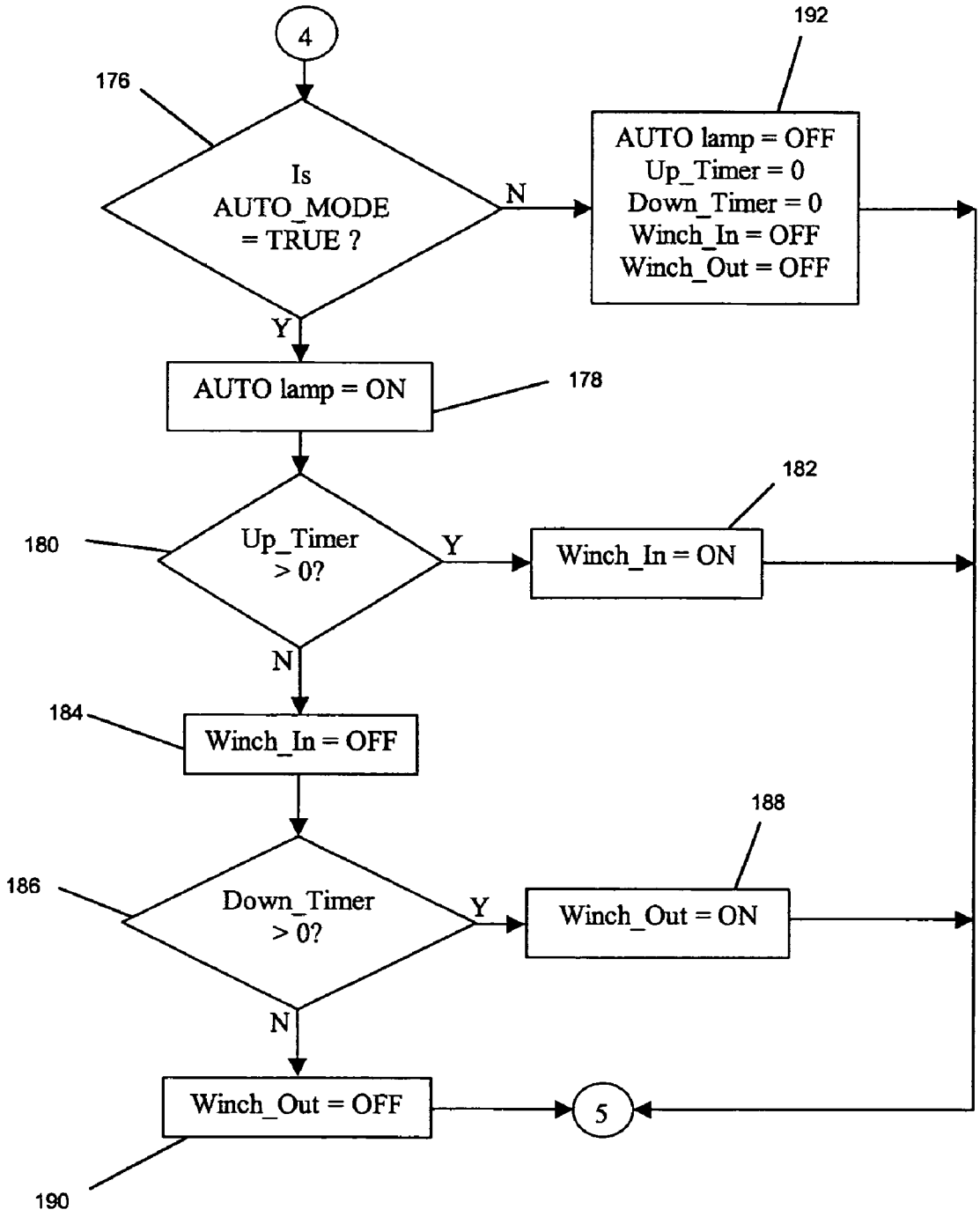
Figure 4E:
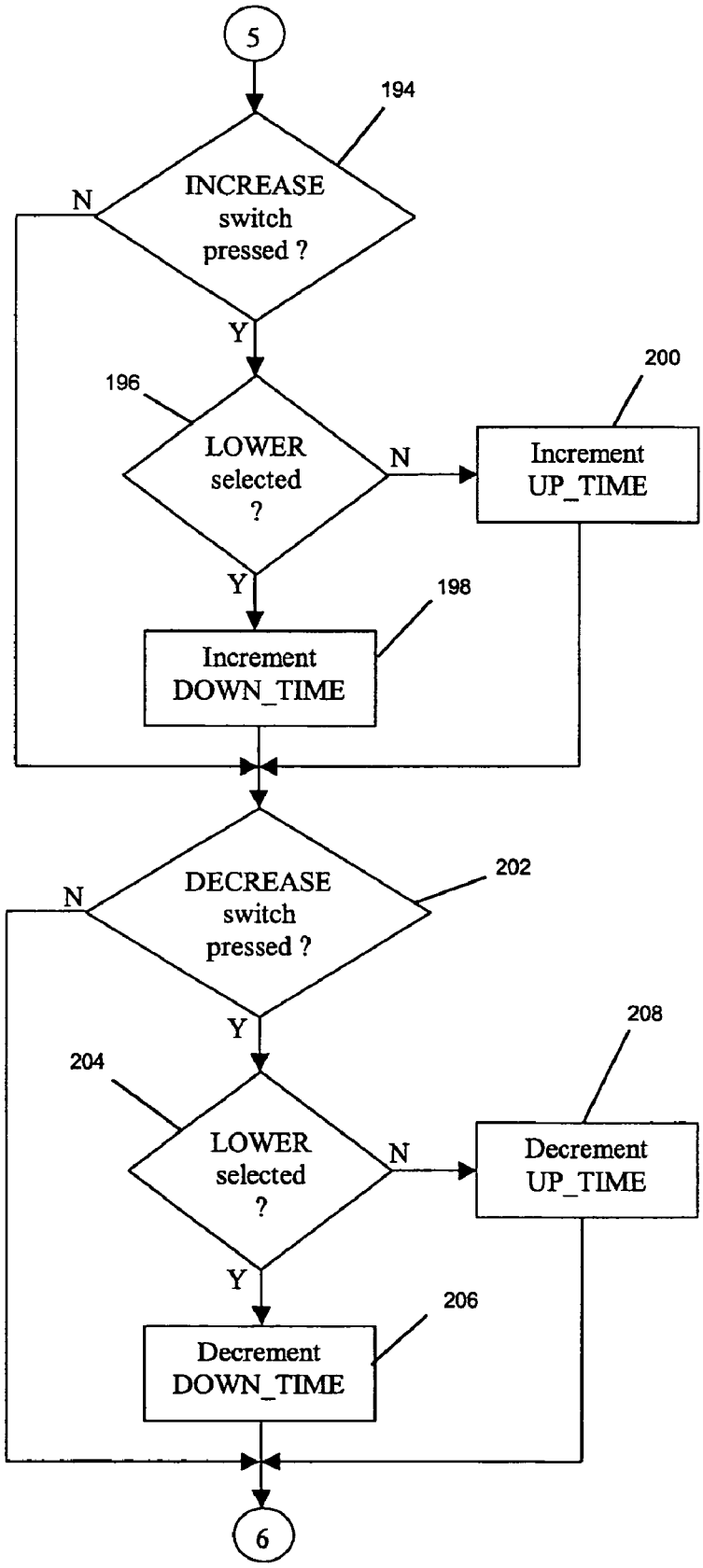
Figure 4F:
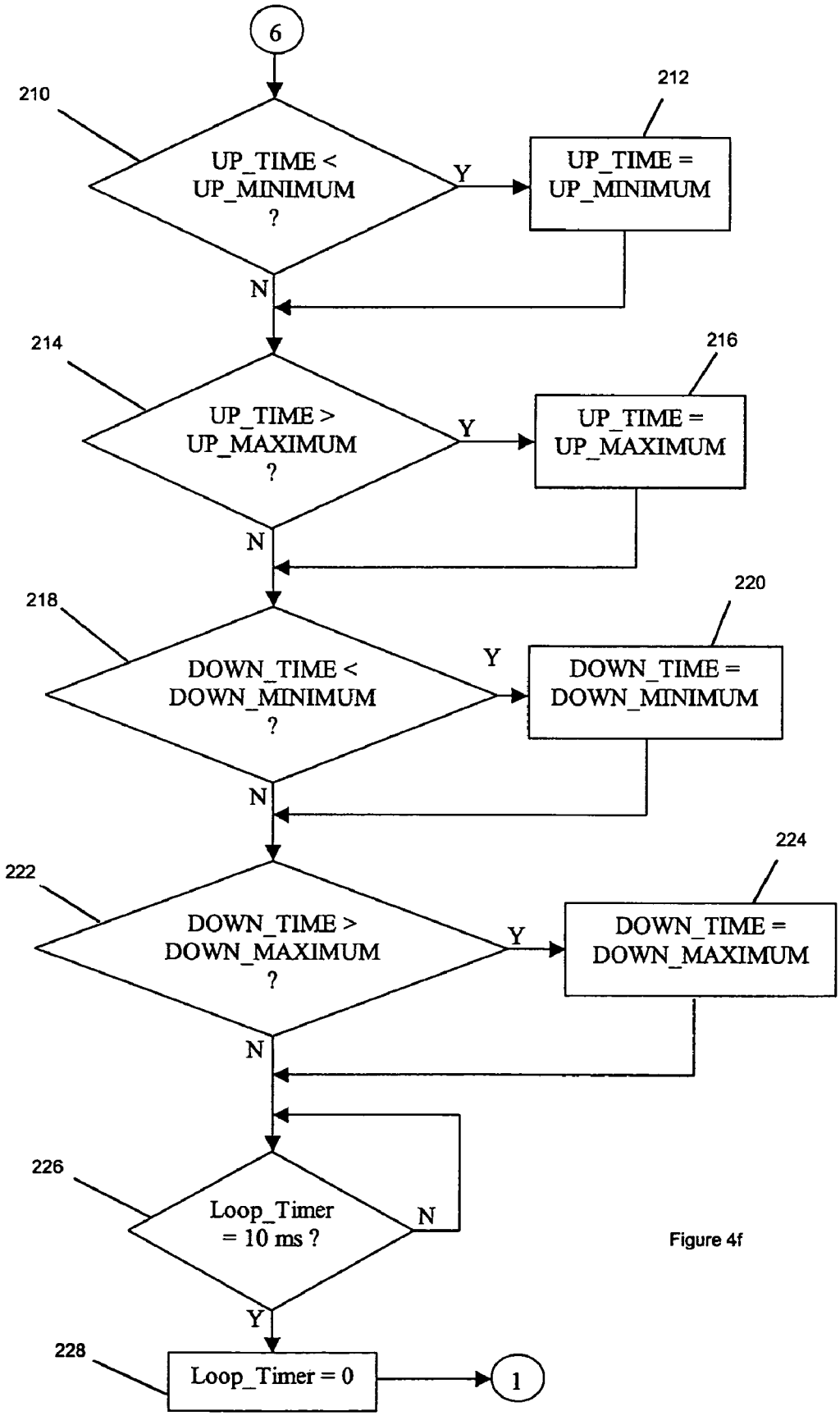

FIGS. 4*a*-4*f* illustrates a flowchart of the logic implemented in the controller of FIG. 3 involving the operation of an embodiment of a control mechanism for controlling an implement mounted with respect to the all terrain vehicle of FIG. 1 and/or the sport utility vehicle of FIG. 2.

DESCRIPTION

Vehicle 10 shown in FIG. 1 is an all terrain vehicle mounted with implement 12, in this case a front mounted plow. Implement 12 may be raised and/or lowered with respect to vehicle 10. Winch 14 holds cable 16 which, in turn, is coupled to implement 12. Winch 14 is electrically operated to either wind or unwind cable 16 from winch 14. As cable 16 is wound onto winch 14, implement 12 is raised to a higher position with respect to vehicle 10. As cable 16 is unwound from winch 14, gravity allows implement 12 to be lowered to a lower position with respect to vehicle 10. Thus, by electrically operating winch 14, implement 12 may be alternately moved to or from a lower, e.g., operating, position and a higher, e.g., non-operating position.

Similarly, vehicle 10 shown in FIG. 2 is a sport utility vehicle mounted with implement 12, in this case a front mounted plow. Implement 12 may be operated generally as described above with respect to all terrain vehicle illustrated in FIG. 1.

As implement 12 is lowered to a lower position, implement 12, e.g., a plow, may operably be in a better position to contact or come closer to contact with a surface on which vehicle 10 travels in order to operatively move material, e.g., soil or snow, with respect to that surface. As implement 12 is raised to a higher position, implement may generally be moved away from the surface on which vehicle 10 travels allowing vehicle 10 to maneuver unimpeded, or lesser impeded, by implement's 12 contact, or near contact, with the surface.

As vehicle 10 is maneuvered by an operator, it may be desirous to, perhaps repeatedly, move implement 12 up and down to engage and disengage implement 12 from its working position to alternately operatively engage implement 12 and disengage implement 12 to allow vehicle 10 to maneuver. Once a proper operating, e.g., lowered, position for implement 12 is established, it may be desirable to repeatedly return to the same or similar operating position in subsequent lowerings of implement 12.

If implement 12 is manually raised and lowered by an operator, the operator may need to pay close attention as to when winch 14 is wound or unwound in order to repeatedly establish the proper position for implement 12. This may be difficult for the operator to accomplish as the operator may also have to operate vehicle's steering, throttle and/or transmission or gear selector and, possibly, a clutch.

In an embodiment, an automatic control may be established for the raising and lowering of implement 12 for vehicle 10. For example, implement 12 may be raised for a predetermined amount by winding winch 14 for a predetermined period of time. Correspondingly, implement 12 may be lowered a predetermined amount, e.g., to the same operating position as earlier established, by unwinding winch 14 for a second predetermined period of time. The winding period of time may not be the same an the unwinding period of time. Because winch 14 may need to overcome gravity to raise implement 12, the winding period of time may be longer than the unwinding period of time in order for implement 12 to raise and lower by the same amount each time, resulting of the return of implement 12 to the same, or similar, operating position in successive iterations.

It may be the case that implement 12 is generally lowered, or operated, when vehicle 10 is moving in one direction, for example a forward direction, and is generally raised to a non-operating position when vehicle 10 is not moving or is moving in a reverse position. The opposite situation may also be true. In these situations and in an embodiment, a control system for implement 12 may automatically raise and lower implement 12 as the operator of vehicle 10 shifts between forward and reverse gears. The control system may automatically raise implement 12 when vehicle is put into reverse and may automatically lower implement 12 to a pre-set, or previously determined, height when vehicle 10 is shifted into a forward gear. Such automatic raising and lowering of implement 12 allows the operator to concentrate on steering and operating the throttle and brake rather than repeatedly manually operate winch 14. The operator may concentrate on driving vehicle 10. In essence, such automatic control is almost like having a second set of hands to control the height of implement 12. In an embodiment, implement 12 is a snow plow blade. The operator may set the plow blade at the desired plowing height and pushes a set button. The automatic control raises the plow blade as vehicle is shifted into reverse and lowers the plow blade to same established plowing height as vehicle is shifted into forward. The plow blade is automatic controlled as vehicle plows snow, dirt and other materials as the operates concentrates on maneuvering vehicle 10.

FIG. 3 is a schematic of controller 18 used to accomplish automatic control of implement 12. In an embodiment, operation of controller 18 is illustrated through the flow chart of FIGS. 4*a* through 4*f*.

In the following logic description, the variables are defined as follows:

Up_Timer—amount of time left for plow to be raised
Down_Timer—amount of time left for plow to be lowered
UP_TIME—initial amount of time for raising plow
DOWN_TIME—initial amount of time for lower plow
RAISED—flag for indicating the plow is in raised stat
LOWERED—flag for indicating the plow is in lowered state
AUTO_MODE—flag for indicating the automatic circuit is activated
GEAR_STATE—flag for indicating when the transmission is in reverse
LAST_GEAR_STATE—used for detecting changes in gear selection From start 110, initial values are set 112 as follows:

LOWER_TIME=950 milliseconds
RAISE_TIME=1 second
TIMER_MAX=200
TIMER_MIN=50

Auto switch input, which either establishes automatic control of implement 12 or not as desired by the operator, is read and bebounced 114. A sensor which reads whether reverse gear is selected is read and bebounced 116. A sensor which determines whether winch 14 is set to manual control is read and bebounced 118. A sensor which determines whether an increase height button has been pressed by the operator is read and bebounced 120. A sensor which determines whether a decrease height button has been pressed by the operator is read and bebounced 122.

A decision 124 is made as to whether the Up Timer is greater than zero. If so, the Up Timer is decremented 126 and a determination 128 is made as to whether the Up Timer is equal to zero. If so, the Raised=True flag, i.e., implement 12 has been raised to the proper position, is set 130. However, if the Up Timer is not greater than zero, then a determination 132 is made as to whether the Manual Winch button has been pressed. If so, then the Auto Mode flag is set 134 to false.

A decision 136 is made as to whether the Down Timer is greater than zero. If so, the Down Timer is decremented 138 and a decision 140 is made as to whether the Down Timer is equal to zero. If so, the Lowered=True flag, i.e., implement 12 has been lowered to the proper position, is set 142. If the Down Timer is not greater than zero, a determination 144 is made as to whether the Manual Winch button has been pressed. If so, then the Auto Mode flag is set 146 is false.

If the Manual Winch button has not been pressed or if the Down Timer does not equal zero, then a determination 148 is made as to whether the transmission is in reverse. If so, the Gear State is set 150 to Reverse Gear. If not, the Gear State is set 152 to Forward Gear.

A determination 154 is made as to whether the Auto switch has been pressed. If so, a determination 156 is made as to whether the Auto Mode flag has been set to false. If so, the Auto Mode is set to true (set to auto mode), the Lowered flag is set to true (implement 12 is in the lowered position), the Raised flag is set to false (implement 12 is not in the raised position) and the Last Gear State flag is set to reverse gear (collectively 158). However, if the Auto Mode flag had not been set to false, then the Auto Mode flag is set 160 to false (manual mode).

In either eventuality (Auto switch not pressed; or Auto switch pressed and either Auto Mode equals false or not equals false), a determination 162 is made as to whether the Gear State flag equals the Last Gear State, i.e., whether present gear state equals the last gear state. If not, a determination 164 is made as to whether the Gear State equals reverse gear. If so, a determination 166 is made as to whether the Lowered flag equals true (implement 12 is in the lowered position). If so, the Up Timer is set to equal to the Up Time and the Lowered flag is set 168 to false. In either case, the Last Gear State flag is set 170 equal to the current gear state.

If however, the Gear State flag was not equal to reverse (see 164), then a determination 172 is made as to whether the Raised flag is set to true (implement 12 is in the raised position). If so, the Down Timer is set 174 equal to the Down Time and the Raised flag is set to false (implement 12 is not in the raised position). In either case, the Last Gear State flag is set 170 equal to the current gear state.

If the Gear State flag is equal to the last gear state (see 162) or if the Last Gear State flag is set to the current gear state (see 170), then a determination 176 is made as to whether the Auto Mode flag is set to true (controller is in automatic mode). If so, then the Auto lamp is turned on 178 and a determination 180 is made as to whether the Up Timer is greater than zero. If not, the Winch In flag is set 182 to on (winch 14 winds cable 16). But if so, the Winch In flag is set 184 to off (winch 14 does not wind in) and a determination 186 is made as to whether the Down Timer is greater than zero. If so, the Winch Out flag is turned on 188 (winch 14 unwinds).

If however, the Down Timer is greater than zero (see 186), the Winch Out flag is set 190 to off (winch 14 does not unwind).

If however, Auto Mode is not set to true (see 176), then the Auto lamp is turned off, the Up Timer is set to zero, the Down Timer is set to zero, the Winch In flag is turned off and the Winch Out flag is turned off (collectively 192) (manual mode is entered).

In all circumstances, a determination 194 is made as to whether the Increase switch has been pressed. If so, a determination 196 is made as to whether the Lower is selected. If so, Down Time is incremented 198 (to increase the amount of time that implement 12 is lowered). If not, Up Time is incremented 200 (to increase the amount of time that implement is raised).

If any event, a determination 202 is made as to whether the Decrease switch has been pressed. If so, a determination 204 is made as to whether Lower has been selected. If so, Down Time is decremented 206 (to decrease the amount of time that implement 12 is lowered). If not, Up Time is decremented 208 (to decrease the amount of time that implement is raised).

In any event, a determination 210 is made as to whether Up Time is less than Up Minimum (whether the amount of the up time is less than the minimum up time). If so, then Up Time is set 212 to Up Minimum (the amount of up time is revised to be the minimum up time).

Then a determination 214 is made as to whether Up Time is greater than Up Maximum (whether the amount of up time is greater than the maximum up time). If so, Up Time is set 216 to Up Maximum (the amount of up time is revised to be the maximum up time).

Then a determination 218 is made as to whether Down Time is less than Down Minimum (whether the amount of down time is less than the minimum down time). If so, Down Time is set 220 to Down Minimum (the amount of down time is revised to be the minimum down time).

Then a determination 222 is made as to whether Down Time is greater than Down Maximum (whether the amount of down time is greater than the maximum down time). If so, Down Time is set 224 to Down Maximum (the amount of down time is revised to be the maximum down time).

The process loops 226 until 10 milliseconds has elapsed. When 10 milliseconds has elapsed, the loop timer is set to zero and then process returns to read and debounce the Auto Switch input (see 114).

In an embodiment, the present invention provides a control mechanism for an implement mounted with respect to an all terrain or utility vehicle, the implement being selectively positioned between a lowered position and a raised position. The control mechanism has an electrically operated winch, a cable at least partially wound on the winch and operably coupled to the implement in order to selectively position the implement between the raised position and the lowered position, and a controller operatively coupled to the winch. The controller is configured to move the implement from the lowered position to the raised position by operating the winch in a first direction for a first predetermined period of time. The controller is further configured to move the implement from the raised position to the lowered position by operating the winch in a second direction opposite to the first direction for a second predetermined period of time.

In an embodiment the second predetermined time is determined in order that the implement is lowered an approximately equal amount as that when the implement is raised during the first predetermined period of time.

In an embodiment the first predetermined period of time exceeds the second predetermined period of time.

In an embodiment the controller establishes the lowered positioned upon manual selection by an operator.

In an embodiment the raised position is a function of the lowered position and the first predetermined period of time.

In an embodiment the vehicle has a transmission with a plurality of selectable gear settings, wherein the controller raises or lowers the implement based on which individual one of the plurality of selectable gear settings is selected by a user.

In an embodiment one of the plurality of selectable gear settings is a reverse setting, and wherein the controller selects the raised position when the reverse setting is selected.

In an embodiment one of the plurality of selectable gear settings is a forward setting, and wherein the controller selects the lowered position when the forward setting is selected.

In an embodiment the implement is a snow plow blade.

In another embodiment, the present invention provides a vehicle having an implement mounted with respect to the vehicle, the implement being selectively positioned between a lowered position and a raised position, and a control mechanism. The control mechanism has an electrically operated winch, a cable at least partially wound on the winch and operably coupled to the implement in order to selectively position the implement between the raised position and the lowered position, and a controller operatively coupled to the winch. The controller is configured to move the implement from the lowered position to the raised position by operating the winch in a first direction for a first predetermined period of time. The controller is further configured to move the implement from the raised position to the lowered position by operating the winch in a second direction opposite to the first direction for a second predetermined period of time.

In another embodiment, the present invention provides a control mechanism for an implement mounted with respect to a vehicle, the implement being selectively positioned between a first selected position and a second selected position. The control mechanism has an electrically operated winch, a cable at least partially wound on the winch and operably coupled to the implement in order to selectively position the implement between the first selected position and the second selected position, and a controller operatively coupled to the winch. The controller is configured to move the implement from the first selected position to the second selected position by operating the winch in a first direction for a first predetermined period of time. The controller is further configured to move the implement from the second selected position to the first selected position by operating the winch in a second direction opposite to the first direction for a second predetermined period of time.

In an embodiment the second predetermined time is determined in order that the implement is moved an approximately equal amount as that when the implement is moved during the first predetermined period of time.

In an embodiment the controller establishes the first selected positioned upon manual selection by an operator.

In an embodiment the second selected position is a function of the first selected position and the first predetermined period of time.

In an embodiment one of the plurality of selectable gear settings is a reverse setting, and wherein the controller selects the second selected position when the reverse setting is selected.

In an embodiment one of the plurality of selectable gear settings is a forward setting, and wherein the controller selects the first selected position when the forward setting is selected.

In another embodiment, the present invention provides a method for controlling an implement mounted with respect to an all terrain or utility vehicle. The implement is selectively positioned between a lowered position and a raised position using an electrically operated winch, a cable at least partially wound on the winch and operably coupled to the implement in order to selectively position the implement between the raised position and the lowered position, and a controller operatively coupled to the winch. The method has the steps of, moving the implement from the lowered position to the raised position by operating the winch in a first direction for a first predetermined period of time, and moving the implement from the raised position to the lowered position by operating the winch in a second direction opposite to the first direction for a second predetermined period of time.

In an embodiment the second predetermined time is determined in order that the implement is lowered an approximately equal amount as that when the implement is raised during the first predetermined period of time.

In an embodiment the first predetermined period of time exceeds the second predetermined period of time.

In an embodiment, the method has the additional step an operator manually selecting the lowered position.

In an embodiment the raised position is a function of the lowered position and the first predetermined period of time.

In an embodiment the vehicle has a transmission with a plurality of selectable gear settings, and further the method also has the step of selecting an individual one of the plurality of selectable gear settings by an operator, wherein the moving steps occur based on which individual one of the plurality of selectable gear settings is selected by the operator.

In an embodiment one of the plurality of selectable gear settings is a reverse setting, and wherein the selecting step selects the moving step corresponding to the raised position.

In an embodiment one of the plurality of selectable gear settings is a forward setting, and wherein the selecting step selects the moving step corresponding to the lowered position.

Thus, embodiments of the implement control system for an all terrain or utility vehicle and method are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A control mechanism for an implement mounted with respect to an all terrain or utility vehicle, said implement being selectively positioned between a lowered position and a raised position, comprising:

an electrically operated winch;

a cable at least partially wound on said winch and operably coupled to said implement in order to selectively position said implement between said raised position and said lowered position;

a controller operatively coupled to said winch, said controller being configured to move said implement from said lowered position to said raised position by operating said winch in a first direction for a first predetermined period of time, and said controller being configured to move said implement from said raised position to said lowered position by operating said winch in a second direction opposite to said first direction for a second predetermined period of time.

2. The control mechanism as in claim 1 wherein said second predetermined time is determined in order that said implement is lowered an approximately equal amount as that when said implement is raised during said first predetermined period of time.

3. The control mechanism as in claim 2 wherein said first predetermined period of time exceeds said second predetermined period of time.

4. The control mechanism as in claim 1 wherein said controller establishes said lowered positioned upon manual selection by an operator.

5. A control mechanism as in claim 1 wherein said raised position is a function of said lowered position and said first predetermined period of time.

6. A control mechanism as in claim 1 wherein said vehicle has a transmission with a plurality of selectable gear settings, wherein said controller raises or lowers said implement based on which individual one of said plurality of selectable gear settings is selected by a user.

7. A control mechanism as in claim 6 wherein one of said plurality of selectable gear settings is a reverse setting, and wherein said controller selects said raised position when said reverse setting is selected.

8. A control mechanism as in claim 7 wherein one of said plurality of selectable gear settings is a forward setting, and wherein said controller selects said lowered position when said forward setting is selected.

9. A control mechanism as in claim 8 wherein said implement is a snow plow blade.

10. A system, comprising:

an all terrain or utility vehicle;

an implement mounted with respect to said vehicle, said implement being selectively positioned between a lowered position and a raised position;

a control mechanism, comprising:

an electrically operated winch;

a cable at least partially wound on said winch and operably coupled to said implement in order to selectively position said implement between said raised position and said lowered position;

a controller operatively coupled to said winch, said controller being configured to move said implement from said lowered position to said raised position by operating said winch in a first direction for a first predetermined period of time, and said controller being configured to move said implement from said raised position to said lowered position by operating said winch in a second direction opposite to said first direction for a second predetermined period of time.

11. The system as in claim 10 wherein said second predetermined time is determined in order that said implement is lowered an approximately equal amount as that when said implement is raised during said first predetermined period of time.

12. The system as in claim 11 wherein said first predetermined period of time exceeds said second predetermined period of time.

13. The system as in claim 10 wherein said controller establishes said lowered positioned upon manual selection by an operator.

14. A system as in claim 10 wherein said raised position is a function of said lowered position and said first predetermined period of time.

15. A system as in claim 10 wherein said vehicle has a transmission with a plurality of selectable gear settings, wherein said controller raises or lowers said implement based on which individual one of said plurality of selectable gear settings is selected by a user.

16. A system as in claim 15 wherein one of said plurality of selectable gear settings is a reverse setting, and wherein said controller selects said raised position when said reverse setting is selected.

17. A system as in claim 16 wherein one of said plurality of selectable gear settings is a forward setting, and wherein said controller selects said lowered position when said forward setting is selected.

18. A system as in claim 17 wherein said implement is a snow plow blade.

19. A method for controlling an implement mounted with respect to an all terrain or utility vehicle, said implement being selectively positioned between a lowered position and a raised position, using an electrically operated winch, a cable at least partially wound on said winch and operably coupled to said implement in order to selectively position said implement between said raised position and said lowered position, and a controller operatively coupled to said winch, comprising the steps of:

moving said implement from said lowered position to said raised position by operating said winch in a first direction for a first predetermined period of time;

moving said implement from said raised position to said lowered position by operating said winch in a second direction opposite to said first direction for a second predetermined period of time.

20. The method as in claim 19 wherein said second predetermined time is determined in order that said implement is lowered an approximately equal amount as that when said implement is raised during said first predetermined period of time.

21. The method as in claim 20 wherein said first predetermined period of time exceeds said second predetermined period of time.

22. The method as in claim 19 wherein further comprising the step of selecting said lowered position manually by an operator.

23. A method as in claim 19 wherein said raised position is a function of said lowered position and said first predetermined period of time.

24. A method as in claim 19 wherein said vehicle has a transmission with a plurality of selectable gear settings, and further comprising the step of selecting an individual one of said plurality of selectable gear settings by an operator, wherein said moving steps occur based on which individual one of said plurality of selectable gear settings is selected by said operator.

25. A method as in claim 24 wherein one of said plurality of selectable gear settings is a reverse setting, and wherein said selecting step selects said moving step corresponding to said raised position.

26. A method as in claim 25 wherein one of said plurality of selectable gear settings is a forward setting, and wherein said selecting step selects said moving step corresponding to said lowered position.

27. A method as in claim 26 wherein said implement is a snow plow blade.

* * * * *

UNITED STATES PATENT AND TRADEMARK OFFICE

CERTIFICATE OF CORRECTION

PATENT NO. : 8,019,515 B2
APPLICATION NO. : 12/202786
DATED : September 13, 2011
INVENTOR(S) : Shane Okeson and Dave Osterman It is certified that error appears in the above-identified patent and that said Letters Patent is hereby corrected as shown below:

Column 9:

Line 52, the word “positioned” should read --position--

Column 10:

Line 34, the word “positioned” should read --position--

Signed and Sealed this
Thirty-first Day of July, 2012

David J. Kappos

David J. Kappos
*Director of the United States Patent and Trademark Office*